United States Patent [19]

Tischlinger

[11] 4,059,112

[45] Nov. 22, 1977

[54] DISPOSABLE ADDITIVE SYRINGE

[76] Inventor: Edward A. Tischlinger, 7 Froghollow Road, East Lyme, Conn. 06333

[21] Appl. No.: 743,219

[22] Filed: Nov. 19, 1976

[51] Int. Cl.[2] ..... A61J 1/00

[52] U.S. Cl. ..... 128/272.3; 128/221; 141/329

[58] Field of Search ..... 128/218 D, 218 DA, 218 N, 128/218 NV, 218 M, 218 R, 221, 272.1, 272.3, 220; 141/2, 18, 311, 329; 215/247

[56] References Cited

U.S. PATENT DOCUMENTS

| | | | |
|---|---|---|---|
| 3,375,825 | 4/1968 | Keller | 128/221 |
| 3,608,550 | 9/1971 | Stawski | 128/272.3 |
| 3,826,261 | 7/1974 | Killinger | 128/272 |
| 3,995,630 | 12/1976 | Van De Veerdonk | 128/218 DA |

*Primary Examiner*—John D. Yasko
*Attorney, Agent, or Firm*—Y. Judd Azulay

[57] ABSTRACT

A disposable additive syringe having a cylindrical barrel closed at the rear end by a slidable plunger and at the front end by a diaphragm assembly including a flexible and pierceable wall defining a medicament chamber between the plunger and the flexible wall. A cap and spike assembly mounted on the front end of the cylindrical barrel, said spike being positioned so that its end will be spaced from and outside the flexible wall and having a passage therethrough, a cannula extending forwardly from the cap and in fluid communication with the spike, a cylindrical safety guide extending forwardly from the cap and surrounding the cannula, a spike mounted by the safety guide and in fluid communication with the cannula, and a sheath supported by and covering the spike.

6 Claims, 3 Drawing Figures

10
12
14
16
17
18
20
22
24
26
30
32
34
38
40
44
46
48
50
54
56
60
62
63
64
70
72
76
78
79
80
82
84
86
90
92
96
98
100
102
104
106
A

DISPOSABLE ADDITIVE SYRINGE

BACKGROUND AND SUMMARY OF THE INVENTION

This invention relates to syringes and more particularly to disposable additive syringes. These syringes generally contain specific and possibly potent medicaments which are then transferred to bottles or flexible receptacles containing an additional liquid which may be little more than a carrier.

There has been a need for a disposable syringe which is readily adapted for use in medicament transfer to a bottle or flexible receptacle with only simple and foolproof changes in the syringe. Additionally, the syringe should be of such construction that it cannot readily be used to inject medicament directly into a patient. The potency of the medicament in an additive unit is such that if directly injected into a patient death could result therefrom.

The matter of economy of construction is also a most important factor since these additive units are disposable.

In view of the foregoing it is an object of this invention to provide a disposable additive syringe which is readily adaptable for use in conjunction with a bottle or a flexible receptacle.

It is another object of this invention to provide a disposable additive syringe which cannot be readily used to inject medicament into a patient.

It is yet another object of this invention to provide a disposable additive syringe which is inexpensive and yet completely reliable.

The above and additional objects and advantages will become apparent when taken in conjunction with the following detailed description and drawing, showing by way of example a preferred embodiment of the invention.

IN THE DRAWING

DETAILED DESCRIPTION OF THE INVENTION

Figures 1, 2, 3:
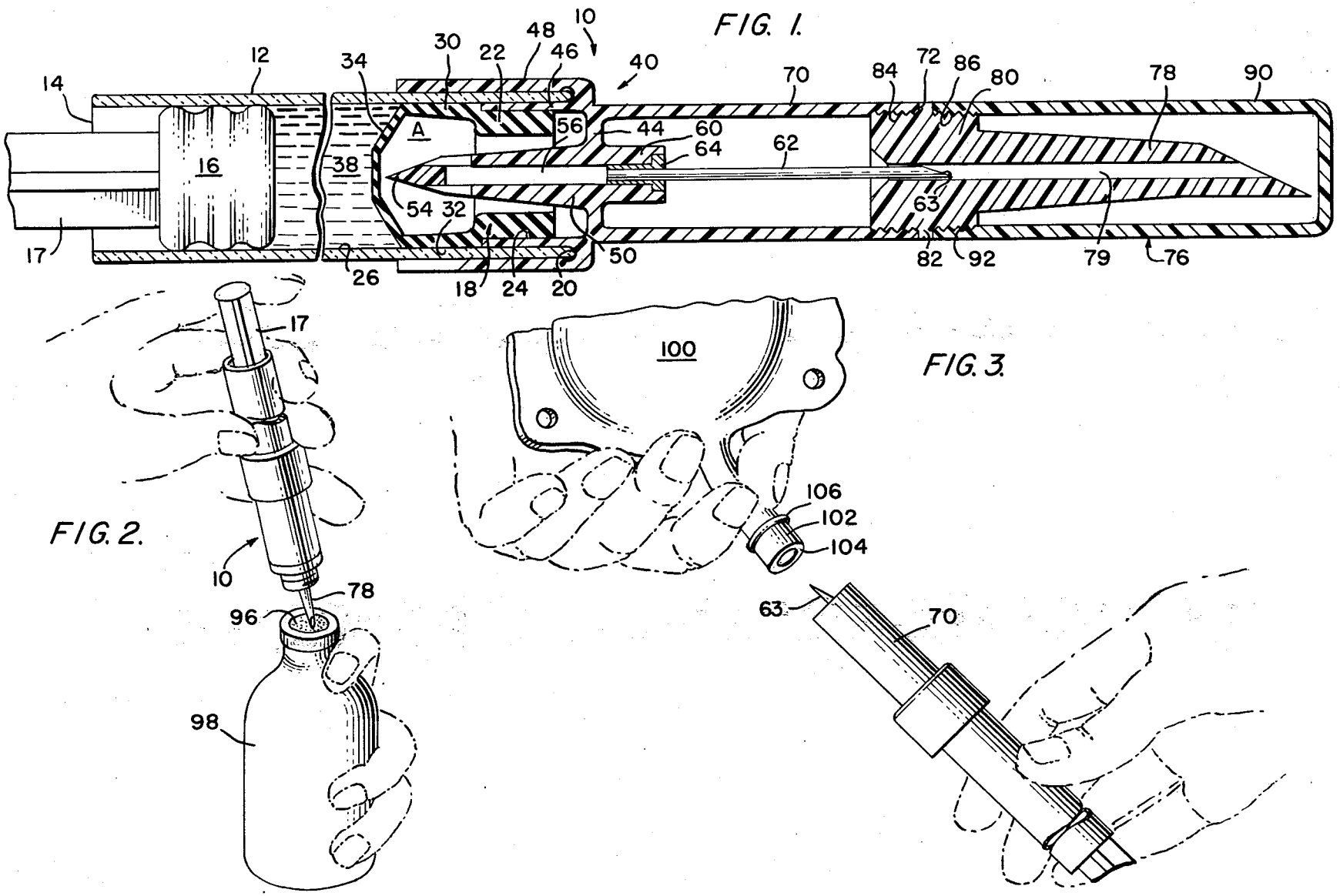
FIG. 1 is a longitudinal cross sectional view of the additive syringe.
FIG. 2 is a pictorial view illustrating the use of the syringe for bottle injection.
FIG. 3 is a pictorial view showing the use of the syringe for flexible bag injection.

As illustrated in FIG. 1 the disposable additive syringe 10 comprises a cylindrical barrel 12 closed at its rearward end 14 by plunger 16. A diaphragm assembly 18 is positioned in the forward end 20 of the cylindrical barrel 12 to close off same. The diaphragm assembly 18 includes a cylindrical forward body portion 22 having an outer surface 24 of a diameter less than that of the inside surface 26 of the cylindrical barrel 12 so that the outer surface 24 of the forward body portion 22 is spaced from the inside surface 26 of the cylindrical barrel 12. A rearward cylindrical body portion 30 extends rearwardly from forward body portion 22 and is sized such that its outer surface 32 sealingly engages the inside surface 26 of the cylindrical barrel 12. A flexible wall 34 closes off the rearward end of the rearward body portion 30. It should be noted that the flexible wall 34 is convexed rearwardly for purposes to be discussed later. A medicament chamber 38 is formed between the plunger 16 and the flexible wall 34.

A cap and spike assembly 40 is fitted on the forward end portion of cylindrical barrel 12. The cap includes a body portion 44 with spaced coaxial inner and outer sleeves 46 and 48 extending rearwardly therefrom. The inner and outer sleeves 46 and 48 are sized to snugly receive and grip the end portion of the cylindrical barrel 12. It should be noted that the inner sleeve 46 is sized such that it fits between the inside surface 26 of the cylindrical barrel 12 and the outer surface 26 of the cylindrical barrel 12 and the outer surface 24 of the forward body portion 22 of the diaphragm assembly 18. The cap body portion 44 mounts a spike 50 which is positioned coaxially with the cylindrical barrel 12 and has its point 54 directed toward and spaced from the flexible wall 34 of the diaphragm assembly 18. A central passage 56 is formed in the spike 50 to provide communication between the diaphragm chamber A and the forward end of the spike.

A cylindrical projection 60 extends forwardly from cap body portion 44 coaxially with the spike passage 56. A cannula 62 is mounted in the projection body 60 by suitable securing means 64 so that it is in fluid communication with spike passage 56. A cylindrical safety guide 70 extends forwardly from cap body 44 and surrounds the cannula 62. The length of the cannula 62 is such that its point 63 extends slightly beyond the end 72 of the safety guide 70.

The inner end portion 74 of the safety guide 70 is threaded to threadedly mount a spike assembly 76 which includes a spike 78 having a circular base 80 with a peripheral flange 82 midway its length. The outer portions 84 and 86 on either side of the flange 82 are oppositely threaded, i.e. portion 84 is left hand thread while portion 86 is right hand thread. A sheath 90 is threadedly secured to the spike 78 by means of inner right hand threaded section 92 which engages body threaded portion 86. The spike 78 is threadedly affixed to safety guide 70 by means of threads 71 on the inner surface of the forward end thereof which mate with spike base threads 84 and is provided with a central throughbore 79 sized such that the end portion of the cannula 62 will snugly engage the wall of bore 79 so that there will be little or no leakage when fluid is dispensed through the cannula 62 and out the spike 78.

This disposable additive syringe 10 is adapted for two specific uses, the first to add medicament to a bottle and the second to add medicament to a flexible bag of the Travenol type. More particularly, as shown in FIG. 2, the sheath 90 has been removed and the spike 78 is being pushed through the bottle stopper 96 after which the plunger rod 17 will be pushed forwardly to cause the medicament in the medicament chamber 38 to flex the flexible wall 34 toward the spike end 54 which upon engagement with the spike point 54 will be pierced so that the medicament may flow from chamber 38 through spike passage 56, through cannula 62 and out through spike bore 79 into bottle 98.

In using the syringe 10 to introduce medicament into a flexible bag 100, the sheath 90 is rotated clockwise thereby unthreading spike body portion 84 from the safety guide 70 to expose the cannula end 63. As shown in FIG. 3, the bag nipple 102 is sized so that it will fit within safety guide 70 whereby the cannula end 63 will penetrate the nipple end 104 and allow the safety guide end 72 to engage nipple shoulder 106 to control the depth to which the nipple 102 passes into the safety guide 70. The injection of medicament from the medicament chamber 38 is the same as set forth previously except for the fact there is no spike at the end of the cannula.

The safety guide 70 serves another useful function, by exposing only a limited portion of the cannula end 63 it is virtually impossible to make a mistake and inject the medicament directly into a patient.

What is claimed is:

1. A disposable additive syringe having a cylindrical barrel closed at the rear end by a slidable plunger and at the front end by a diaphragm including: a flexible wall facing rearwardly in a convex manner, a medicament chamber formed between the slidable plunger and the flexible wall, a cap and spike assembly mounted on the forward end portion of the cylindrical barrel, said spike being positioned within the cylindrical barrel with its pointed end spaced from and outside the flexible wall, said spike having a passage therethrough, a cannula extending forwardly from the cap and spike assembly in fluid communication with the spike passage, a cylindrical safety guide surrounding the cannula in a spaced manner, a spike mounted on the forward end portion of the safety guide, said spike having a throughbore aligned with the cannula whereby the forward end portion of the cannula fits within said throughbore, and a sheath covering the spike.

2. The invention as set forth in claim 1 and wherein the cap and spike assembly are of unitary construction.

3. The invention as set forth in claim 1 and wherein the cap and spike assembly and the cylindrical safety guide are of unitary construction.

4. The invention as set forth in claim 1 and wherein the spike mounted on the forward end portion of the cylindrical safety guide has a circular base portion provided with two oppositely threaded sections, one to cooperate with threads on the forward end portion of the cylindrical safety guide and the other to cooperate with threads on the rearward end of the sheath.

5. A disposable additive syringe having a cylindrical barrel closed at the rear end by a slidable plunger and at the front end by a diaphragm including a body portion sealingly engaging the inner wall of the cylindrical barrel and a flexible wall connected to the rearward side of the body and extending rearwardly therefrom, a medicament chamber formed between the slidable plunger and the flexible wall, a cap and spike assembly mounted on the forward end portion of the cylindrical barrel, said cap fitting over the cylindrical barrel and supporting the spike so that its end will be spaced from and outside the flexible wall, said spike having a passage therethrough, a cylindrical projection extending forwardly from the cap and axially aligned with the spike passage, a forwardly extending cannula mounted by the projection, a cylindrical safety guide extending forwardly from the cap and surrounding the cannula in a spaced manner, a spike mounted on the end portion of the safety guide, said spike having a throughbore aligned with the cannula whereby the forward end portion of the cannula will fit within said throughbore, and a sheath threadedly secured to the spike to cover same.

6. The invention as set forth in claim 5 and wherein the cannula is slightly longer than the cylindrical safety guide whereby the end portion of the cannula extends only slightly beyond the end of the guide so that injection into a patient is virtually impossible.

* * * * *